United States Patent [19]

Drabowitch

[11] 4,048,592

[45] Sept. 13, 1977

[54] ARRANGEMENT FOR EXTRACTING DIVERGENCE-MEASURING MODES FROM A CORRUGATED GUIDE AND TRACKING ANTENNA INCORPORATING SAME

[75] Inventor: Serge Drabowitch, Paris, France

[73] Assignee: Thomson-CSF, Paris, France

[21] Appl. No.: 661,821

[22] Filed: Feb. 26, 1976

[30] Foreign Application Priority Data

Feb. 28, 1975 France ..... 75.06254

[51] Int. Cl.[2] ..... H01P 5/08; H01P 3/12; H01Q 13/06; H01P 1/16

[52] U.S. Cl. ..... 333/6; 333/11; 333/21 R; 333/95 R; 333/98 R; 333/98 M; 343/786

[58] Field of Search ..... 333/1, 98 M, 98 R, 10, 333/11, 27, 21 R, 21 A, 73 W, 95 R, 95 A; 343/786, 776, 781

[56] References Cited

U.S. PATENT DOCUMENTS

| | | | |
|---|---|---|---|
| 3,413,642 | 11/1968 | Cook | 333/21 R X |
| 3,715,688 | 2/1973 | Woodward | 333/1 |
| 3,922,621 | 11/1975 | Gruner | 333/98 M X |

*Primary Examiner*—Alfred E. Smith
*Assistant Examiner*—Marvin Nussbaum
*Attorney, Agent, or Firm*—Karl F. Ross

[57] ABSTRACT

An arrangement is described for extracting divergence-measuring modes from a corrugated guide connected on the one hand to a corrugated horn and on the other to a utilization device. The arrangement includes at least two pairs of collector waveguides lying in diametrically opposite positions along the corrugated guide to which they are coupled by slots formed in the wall of the corrugated guide in which the divergence-measuring modes are propagated. Two, at least, of these modes are extracted as a function of their phase velocity and are processed to produce divergence-measuring signals. The arrangement is advantageously used in antennas for tracking satellites or missiles.

15 Claims, 13 Drawing Figures

ARRANGEMENT FOR EXTRACTING DIVERGENCE-MEASURING MODES FROM A CORRUGATED GUIDE AND TRACKING ANTENNA INCORPORATING SAME

BACKGROUND OF THE INVENTION

The present invention relates to an arrangement for extracting divergence-measuring modes from a corrugated guide. It also relates to the application of such an arrangement to a tracking antenna.

By a corrugated guide is meant a guide, generally of circular cross-section, which contains transverse grooves whose depth is of the order of a quarter of the operating wavelength and which are spaced apart by a fraction of this wavelength.

In my copending application Ser. No. 533,722, now U.S. Pat. No. 3,964,070, I have described means for extracting divergence-measuring modes from a corrugated horn. In that prior patent I have pointed out the benefit of using corrugated horns in tracking antennas, such horns having radiation diagrams which are almost figures of revolution with low sidelobes, and having stable amplitude and phase characteristics over frequency ranges of little less than an octave. These useful properties of corrugated horns are also made use of in a system according to my present invention, in which the divergence-measuring modes are extracted from a corrugated guide connected to the horn.

In fact, in the context of the invention the divergence-measuring modes have to be extracted in an area where the phase velocity of the useful modes is substantially constant, which is not the case in a horn where the phase velocity varies continuously along the wall of the horn, thus making it more difficult to use the differing phase velocities of the useful modes as a criterion to select the those modes.

SUMMARY OF THE INVENTION

According to the invention there is provided an arrangement for extracting divergence-measuring modes in a corrugated guide, which has in its wall a certain number of transverse grooves whose depth is of the order of a quarter of the operating wavelength, and which are spaced apart by a fraction of this wavelength and in which a fundamental hybrid mode and upper, odd or divergence-measuring, modes may be propagated, the guide being connected at one of its ends to a horn which is also corrugated and at its other end to a utilization device. The extraction is performed by collector waveguides positioned along the outside wall of the corrugated guide to which latter they are coupled by formative such as slots in its wall, the dimensions of the collector guides being such that the phase velocity of their fundamental mode is equal to that of the divergence-measuring modes which are propagated in the corrugated guide.

According to another feature of the invention, the collector guides making up each pair are diametrically opposite on the corrugated guide and two such pairs lying in two mutually orthogonal planes, work into hybrid couplers or magic Tees which make it possible to obtain, as outputs, components which are in phase with and in phase opposition to the signals extracted by the collector guides from the central corrugated guide.

BRIEF DESCRIPTION OF THE DRAWINGS

The invention will be better understood and its advantages will become apparent from the following description of some embodiments, given with reference to the accompanying drawing in which.

DETAILED DESCRIPTION OF THE INVENTION

In tracking antennas, if the axis of the antenna does not point directly in the direction of the radiating object being tracked, which may be the beacon of a satellite for example, this gives rise in the horn of the primary feed to upper modes whose nature and level are generally indicative of the angular aiming errors in bearing and elevation. Extraction of these upper modes thus provides the great benefit that it enables error signals to be generated which can be used to lock the antenna back onto the object being tracked.

However, of the upper modes available, it is a question of selecting particularly those which have the characteristics most useful for tracking purposes and then of extracting these modes to the exclusion of others and, in so doing, avoiding any interferring with the propagation of the fundamental mode. These modes are also called odd modes or divergence-measuring modes, the reason being that in the case of an odd mode the radiation diagram is such that in any given plane of symmetry its characteristic radiation function is odd.

Figure 1:
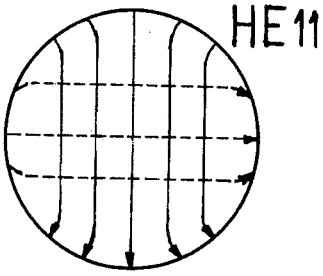
FIG. 1 shows a diagram of the HE 11 mode.
Figure 2:
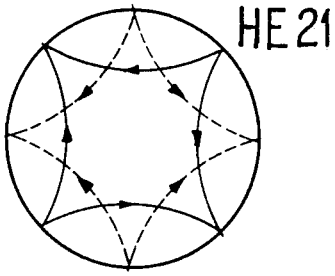
FIG. 2 shows a diagram of the HE 21 mode.
Figure 3:
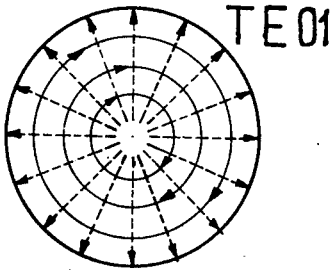
FIG. 3 shows a diagram of the TE 01 mode.
Figure 4:
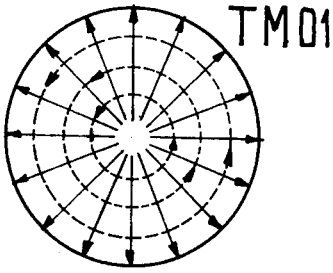
FIG. 4 shows a diagram of the TM 01 mode.

In the case of the corrugated guides which are used in the context of the present invention, the fundamental mode is the HE 11 mode of which a diagram is shown in FIG. 1 (with the electric and the magnetic field respectively represented by full and dotted lines, as in my prior patent). The first upper modes capable of supplying the required signals for angular error are the HE 21 mode and the TE 01 and TM 01 modes, diagrams of which are shown in FIGS. 2, 3 and 4 respectively. In light of the foregoing discussion it will be seen that these modes have characteristics which are helpful in solving the problem which exists. Their characteristic surface for power is a figure of revolution about the axis and their phase velocities, under conditions of assumed hybrid balance, are close to one another, contrary to what they would be in a smooth-walled guide.

All these modes are propagative and, in discussing a first aspect of the invention, an arrangement will be described which extracts the TM 01 and HE 21 modes.

In this case the coupling slots formed in the walls of the corrugated guide are transverse and may be made at the bottom of the grooves in the guide.

Figure 5:
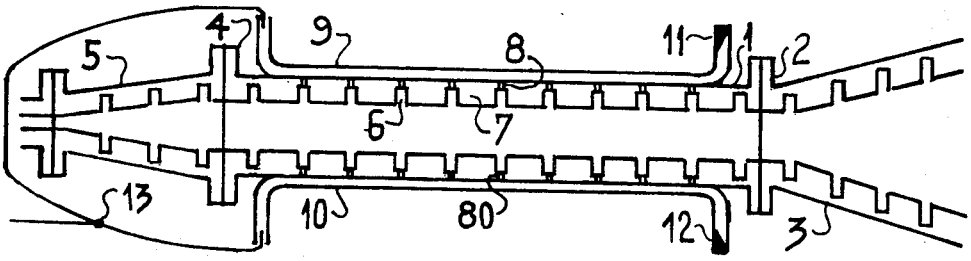
FIG. 5 is a view in longitudinal section of an extracting arrangement according to my invention with transverse coupling slots.

FIG. 5 is a schematic view in longitudinal section of the arrangement for extracting odd modes from a corrugated guide. Guide 1 is a straight guide of constant cross-section, preferably circular, connected by a flange 2 to a corrugated horn 3, which may constitute the radiating aperture of the primary feed of a tracking antenna, and by a flange 4 to a utilization device via a transformer section 5 which is also corrugated. The corrugations of the guide structure define grooves 6 separated by ridge 7. At the bottom of the grooves 6, or at least of most of them, are formed transverse slots 8, 80 coupling the guide 1 to at least two diametrically opposite waveguides 9 and 10, termed collectors, which terminate at one end in a load 11, 12 or a short-circuit.

A second pair of collector guides 90 and 100 (FIG. 6), which are situated in a plane perpendicular to that containing guides 9 and 10, are provided to extract, in conjunction with the first pair, the odd modes which are propagated in the corrugated guide. The collector guides making up this second pair are coupled to the corrugated central guide by tranverse coupling slots 81, 82 provided at the bottoms of the grooves 6. The dimensions of the collector guides are selected so that the phase velocity of their fundamental mode is equal to those of the TM 01 and HE 21 modes which are propagated in the corrugated guide 1.

Figure 6:
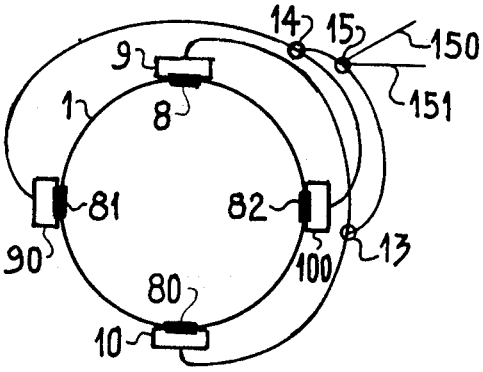
FIG. 6 is a cross-sectional view of the arrangement of FIG. 5.

The parameter which is used for the operation of extracting the odd divergence-measuring modes is thus the phase velocity in the corrugated guide 1, this guide being so designed that the phase velocities of the modes propagated in it are the same. The four collector guides, split up into their two pairs, are connected by magic Tees, one of which, marked 13, can be seen in FIG. 5. These magic Tees make it possible to extract the components of the signals received by the collector guides which are in phase and in phase opposition, thus giving rise to the desired divergence. FIG. 6 shows the connections formed between the pairs of collector guides 9, 10 and 90, 100 by magic Tees 13, 14 and 15; outputs 150 and 151 of Tee 15 which supply the divergence-measuring signals associated with the TM 01 and HE 21 modes are selected and extracted.

Figure 7:
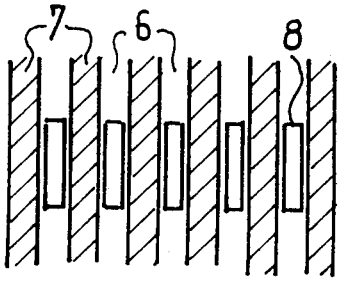
FIGS. 7 and 8 are views in plan and section respectively of an array of transverse slots as used in the system of FIGS. 5 and 6.
Figure 8:
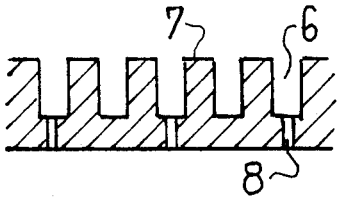

FIG. 7 is a plan view of a number of the corrugations in guide 1 showing the ridges 7 and the grooves 6 tranverse slots 8. FIG. 8 is a sectional view of some of the grooves in guide 1 showing the position of the slots 8 formed in them.

As has been mentioned, the rows of transverse slots in the corrugated guide and the fact of their being coupled to the collector guides make it possible for the signals associated with TM 01 and HE 21 modes to be extracted and collected. Rows of longitudinal slots formed in the corrugated guide would also make it possible to extract and collect the signals associated with the TE 01 and HE 21 modes.

Figure 9:
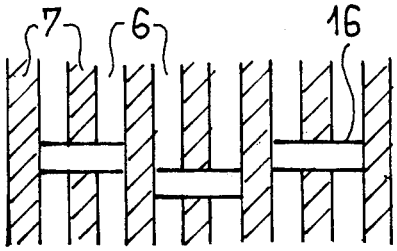
FIGS. 9 and 10 are views in plan and section respectively of an array of longitudinal slots.

FIG. 9 is a plan view of a number of corrugations 6, 7 provided with such longitudinal slots 16.

Figure 10:
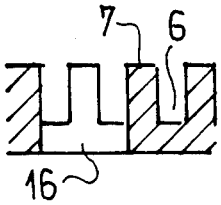

FIG. 10 is a sectional view of some of the corrugations of guide 1 showing the position of longitudinal slots 16 formed in them.

Figure 11:
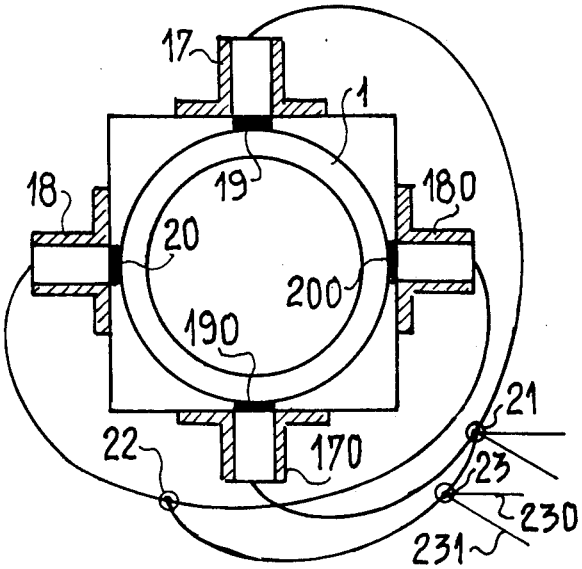
FIG. 11 is a cross-sectional view of an extracting arrangement according to my invention with longitudinal slots.

FIG. 11 is a schematic cross-sectional view of the corrugated guide 1, with two pairs of collector guides coupled to the corrugated guide by longitudinal slots. The guides are marked 17, 170 and 18, 180 and the corresponding coupling slots are designated 19, 190 and 20, 200. As in the previous case, the collector guides are joined together by hybrid couplers or magic Tees 21, 22 and 23, so that there are received at the outputs 230 and 231 of magic Tee 23 the divergence-measuring signals associated with the selected TE 01 and HE 21 modes which are extracted by the arrangement.

Figure 12:
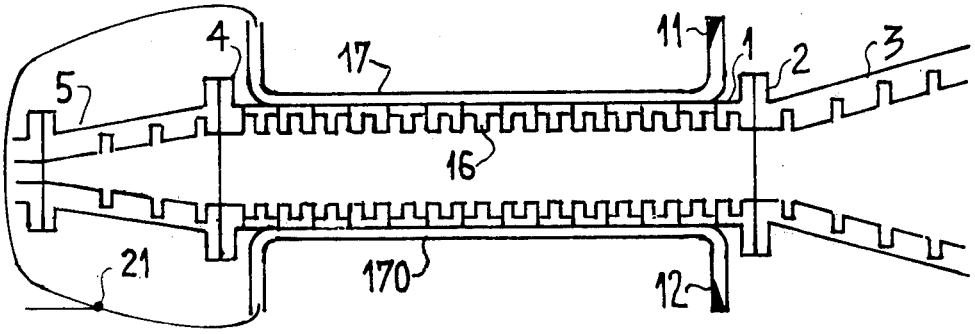
FIG. 12 is a view in longitudinal section of the extracting arrangement of FIG. 11.

FIG. 12 is a schematic side view of an extracting arrangement whose collector guides are distributed around the corrugated guide 1 in two mutually orthogonal planes and are coupled to it by longitudinal slots formed in the wall of the guide. This structure is otherwise very similar to that of FIG. 5.

However, as already mentioned above, in extracting the signals associated with the selected divergence-measuring modes it is necessary to prevent the level of interference signals, associated with an extracted but unselected mode, from exceeding a certain value.

In fact, in the example described, the interference mode is the main hybrid HE 11 and its upon extraction level has to be made negligible in comparison with that of the useful modes, such as the TM 01 and HE 21 modes selected here. In accordance with the invention, this problem of the theoretically desirable cancellation of the extraction of the interference mode, which is the main mode in the present instance, is solved by adjusting the propagation constant $\beta_o$ of the fundamental mode in the collector guides.

The propagation constants of the HE 11, HE 21 and TM 01 modes in the corrugated guide will be called $\beta_{11}$, $\beta_{21}$, $\beta_{01}$ respectively. The dimensions of the corrugated structure are made such, bearing in mind the pass band to be covered, that the propagation constant $\beta_o$ of the modes which are propagated in the collector guides are equal to the constant $\beta_{01}$ shared by the useful divergence-measuring modes, given that there is little difference between the propagation constants $\beta_{01}$ for the HE 21 mode and that $\beta_{01}$ for the TM 01 mode. It can thus be said that $\beta_o = \beta_{01} = \beta_{21}$ and that $\beta_o \neq \cdot\beta_{11}$ defines the difference between the propagation constants of the divergence-measuring modes and of the main mode.

It will be noted that, as a result of the known properties of waveguides and because the change in the phase velocity of a mode depends only as a first approximation on the ratio between operating frequency and cut-off frequency, if these relationships hold for a given frequency then they also do so to a good approximation over the whole of the desired band.

The coupling coefficient between a mode being propagated in the corrugated guide 1 of the propagation constant $\beta_g$ and the mode in the collector guide of propagation constant $\beta_o$ in the case of a pair of diametrically opposite slots $n$ will be called $q_n(\beta_g, \beta_o)$.

If the coefficients $q_n$ are small, the total coupling is of the form:

$$C(\beta_g, \beta_o) = \sum_{o}^{N-1} q_n(\beta_g, \beta_o)\, e^{i n \Delta l (\beta_g - \beta_o)}$$

where $\Delta l$ is the distance between two slots and $(N-1)\Delta l$ is the overall length of the array of slots concerned.

As an example, where $q_n = q_o =$ constant, $$C(\beta_g, \beta_o) = Co \frac{\sin \frac{N}{2} \Delta l (\beta_g - \beta_o)}{N \sin \frac{\Delta l}{2} (\beta_g - \beta_o)}$$

in which $Co = NqO$.

This latter function gives a maximum coupling when $\beta_g = \beta_o$, i.e. in the case of the intended useful divergence-measuring modes. Where $\beta_g$ is different from $\beta_o$, and if the length $L = (N-1/\Delta l)$ of the array of slots is fairly great, the corresponding mode is only coupled by the side lobes of function C; this is the case with the main mode HE 11. However, these side lobes may be reduced, and this is borne out by the theory of arrays, by acting on the weighting law governing the distribution $q_n$ of the coupling coefficients.

The chief characteristics of an arrangement for extracting divergence-measuring modes, conforming to the principles of the invention, will now be given by way of example.

The arrangement operates in the 11.7 GHz to 11.7 GHz band on the one hand and the 14 to 14.5-GHz band on the other hand.

The radius of the corrugated guide is of the order of 18.75 mm, the pitch of the grooves is 5 mm, their depth is 7.5 mm and the distance between the slots is of the order of 10 mm ($\Delta l$).

The propagation coefficients for the other modes, measured at the center of the low range at a frequency value of 11.3 GHz under conditions of assumed hybrid balance, are a follows:

$\beta_o = a_{01} = 2.2 \neq \beta a_{H21}$ $\beta a\ 11 = 3.5$ number of slots N = 20 maximum coupling °log $Co = -10$ dB.

It can be seen that under these conditions there is relatively little coupling to the HE 11 mode. If the coefficients $q_n$ were identical, this would result in interference coupling for HE 11 equal to $-10 - 21 = -31$dB.

Figure 13:
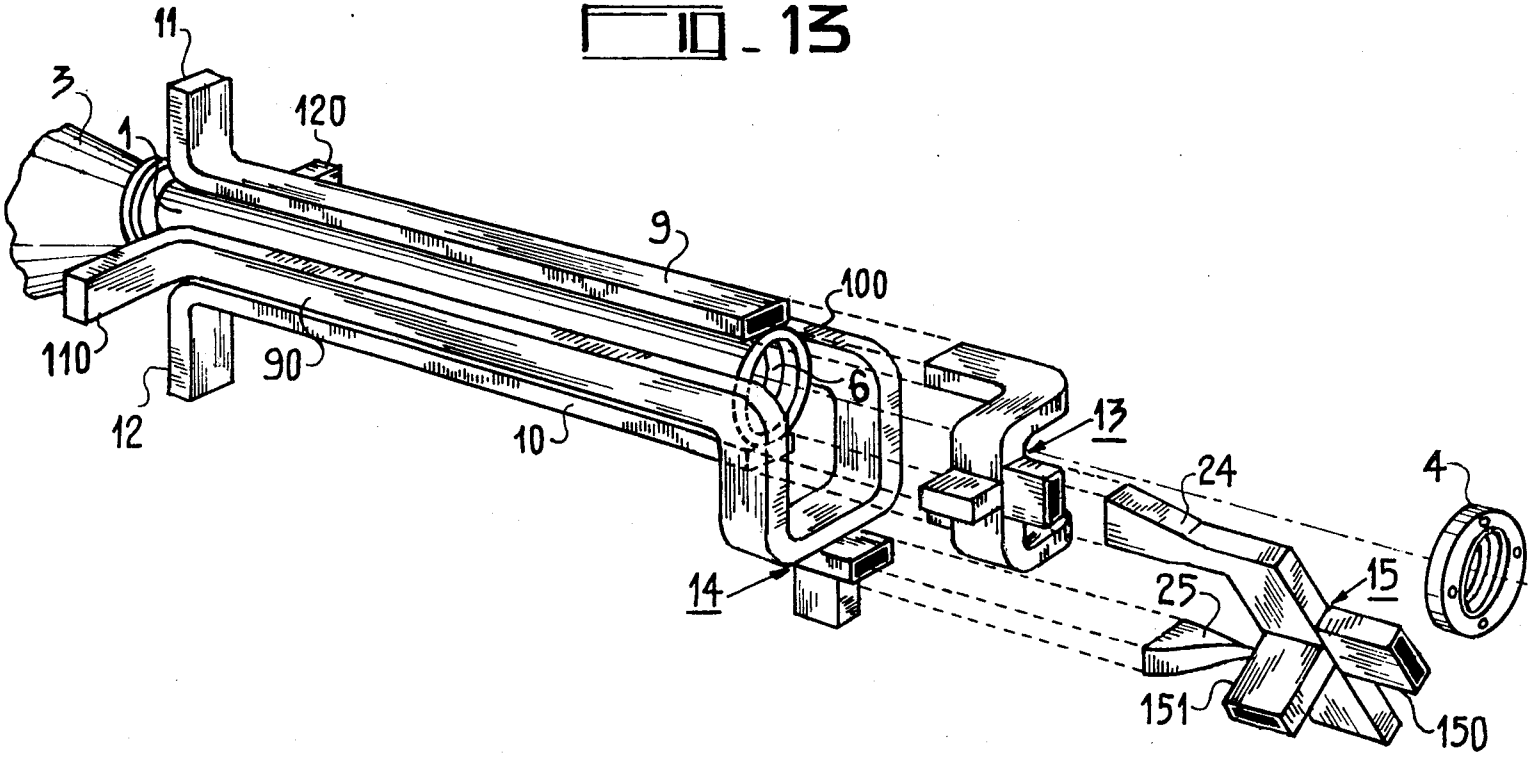
FIG. 13 is a perspective view of an extracting arrangement as shown in preceding Figures.

FIG. 13 is a perspective view of an arrangement for extracting divergence-measuring modes in a corrugated guide with coupling by transverse slots.

The reference numerals used in the previous Figures have of course been used in FIG. 13 for elements already described.

In this Figure can be seen the layout of the arrangement, which has two pairs of diametrically opposite collector guides 9, 10 and 90, 100 and lying in mutually perpendicular planes, each collector guide terminating at one end in a load 11, 12 or 110, 120. The corrugated central guide 1 is coupled to the collector guides by transverse slots 8, 80 and 81, 82 (see FIG. 6) or by longitudinal slots 10, 20 and 190, 200 (see FIG. 11). As in FIGS. 5 and 12, guide 1 is connected to a corrugated horn 3 while a flange 4 connects it at its other end to a nonillustrated utilization device. The diametrically opposite collector guides 9 and 10 are again connected together by a magic Tee 13 whereas collector guides 90 and 100, which are likewise diametrically opposite, are interconnected by a magic Tee 14. The operating arms of these Tees, in which the useful components of the extracted modes make their appearance, are connected by twisted guides 24 and 25 to a second magic Tee 15 whose outputs 150 and 151 provide the desired error signals.

It will be seen that the twisted guide 24, 25 to rotate the electrical fields of the signals issuing from Tees 13 and 14 by 30, 20, 31, 20 +45° and −45°, respectively, so that magic Tee 15 is able to combine them.

My improved waveguide assembly, together with its horn, may form a primary feed of the monopulse type associated with a tracking antenna.

What is claimed is:

1. An arrangement for extracting divergence-measuring modes propagating in a corrugated guide having a wall with an inner surface provided with a multiplicity of transverse grooves having a depth of the order of a quarter wavelength of an operating frequency, said grooves being spaced apart by a fraction of said wavelength, said divergence-measuring modes being upper-odd modes derived from a hybrid fundamental mode propagated along said guide, said arrangement comprising collecting means coupled to said guide for extracting therefrom said divergence-measuring modes, said collecting means being so constructed that the phase velocity of their fundamental mode is equal to that of the divergence-measuring modes.

2. An arrangement according to claim 1 wherein said collecting means are guide means positioned along the outside wall of said corrugated guide and coupled thereto by formations in said wall.

3. An arrangement according to claim 2 wherein said guide means comprise two pairs of collector guides lying in mutually perpendicular planes in diametrically opposite positions along said corrugated guide.

4. An arrangement according to claim 2 wherein said formations are slots formed in said outside wall said guide means comprising a pair of collector guides.

5. An arrangement according to claim 4, wherein said slots are transverse and open into grooves of said corrugated guide.

6. An arrangement according to claim 4 wherein said slots are longitudinal.

7. An arrangement according to claim 3, wherein said collector guides are coupled to said corrugated guide over their entire length, one of their ends terminating in a load.

8. An arrangement according to claim 3, wherein said collector guides are terminated at one of their ends by a short-circuit.

9. An arrangement according to claim 3 wherein said collector guides have ends connected to hybrid couplers with outputs connected to another hybrid coupler having working outputs which supply divergence-measuring signals derived from the extracted modes.

10. An arrangement according to claim 3, wherein the coupling between said collector guides and said corrugated guide is at a maximum for said divergence-measuring modes which are extracted from said corrugated guide and are propagated in said collector guides.

11. An arrangement according to claim 10 wherein the coupling between said collector guides and said corrugated guide is low for the fundamental mode traveling in said corrugated guide.

12. An arrangement according to claim 5 wherein said collector guides extract the TM 01 and HE 21 modes.

13. An arrangement according to claim 6 wherein said collector guides extract the TE 01 and HE 21 modes.

14. An arrangement according to claim 1, further comprising a corrugated horn connected to an end of said corrugated guide.

15. An arrangement according to claim 14 wherein said corrugated guide and said horn are connected to a tracking antenna as a primary feed therefor.

* * * * *